US010440455B2

(12) United States Patent
Fox

(10) Patent No.: US 10,440,455 B2
(45) Date of Patent: Oct. 8, 2019

(54) IMMERSIVE SOUND SYSTEM

(71) Applicant: DreamLight Holdings Inc., Beverly Hills, CA (US)

(72) Inventor: Steve Fox, Los Angeles, CA (US)

(73) Assignee: WILLOWBROOK CAPITAL GROUP, LLC, Los Angeles, CA (US)

( * ) Notice: Subject to any disclaimer, the term of this patent is extended or adjusted under 35 U.S.C. 154(b) by 316 days.

(21) Appl. No.: 14/676,178

(22) Filed: Apr. 1, 2015

(65) Prior Publication Data

US 2015/0208151 A1 Jul. 23, 2015

Related U.S. Application Data

(62) Division of application No. 14/183,208, filed on Feb. 18, 2014, now abandoned.

(60) Provisional application No. 61/766,571, filed on Feb. 19, 2013.

(51) Int. Cl.

| | |
|---|---|
| ***G10K 11/16*** | (2006.01) |
| ***H04R 1/02*** | (2006.01) |
| ***G10K 11/178*** | (2006.01) |
| ***H04R 5/02*** | (2006.01) |
| ***H04R 3/00*** | (2006.01) |
| *H04R 1/22* | (2006.01) |
| *H04R 1/26* | (2006.01) |
| *H04R 3/02* | (2006.01) |
| *H04R 27/00* | (2006.01) |

(52) U.S. Cl.

CPC ..... *H04R 1/025* (2013.01); *G10K 11/178* (2013.01); *H04R 3/002* (2013.01); *H04R 5/023* (2013.01); *G10K 2210/12* (2013.01); *H04R 1/227* (2013.01); *H04R 1/26* (2013.01); *H04R 3/02* (2013.01); *H04R 27/00* (2013.01)

(58) Field of Classification Search

CPC ..... G10K 11/16; H04R 1/02; H04N 21/4223; H04N 21/4788; H04N 5/2257; H04N 7/141; H04N 7/142

USPC ..... 381/301; 297/217.3, 217.4

See application file for complete search history.

(56) References Cited

U.S. PATENT DOCUMENTS

| | | | |
|---|---|---|---|
| 1,868,068 | A | 7/1932 | Moulten |
| 3,512,605 | A | 5/1970 | McCorkle |
| 4,136,935 | A | 1/1979 | Cook et al. |
| 5,025,474 | A | 6/1991 | Tanaka et al. |
| 5,133,017 | A | 7/1992 | Cain et al. |

(Continued)

FOREIGN PATENT DOCUMENTS

| | | |
|---|---|---|
| EP | 1 916 845 | 4/2008 |
| EP | 2 061 261 | 5/2009 |

OTHER PUBLICATIONS

International Preliminary Report on Patentability for PCT/US2014/016947, dated Aug. 25, 2015.

(Continued)

*Primary Examiner* — Md S Elahee

(74) *Attorney, Agent, or Firm* — Foley & Lardner LLP

(57) ABSTRACT

Sound control and audio output systems and methods for an entertainment venue are described. The sound control and audio output systems include an in-seat speaker arrangement. The in-seat speaker arrangement includes a theater chair having a back section and a seat section, one or more top speakers arranged around a headrest area of the back section of the theater chair, and a lower speaker disposed within the seat section of the theater chair.

11 Claims, 5 Drawing Sheets

(56) References Cited

U.S. PATENT DOCUMENTS

| | | | | |
|---|---|---|---|---|
| 5,326,266 | A | 7/1994 | Fisher et al. | |
| 5,376,980 | A | 12/1994 | Gersuk et al. | |
| 5,478,077 | A | 12/1995 | Miyahara | |
| 5,577,350 | A | 11/1996 | Brisbin et al. | |
| 5,765,314 | A | 6/1998 | Giglio et al. | |
| 5,833,544 | A | 11/1998 | Corbin et al. | |
| 5,964,064 | A | 10/1999 | Goddard et al. | |
| 6,017,276 | A | 1/2000 | Elson et al. | |
| 6,151,081 | A | 11/2000 | Gold et al. | |
| 6,237,290 | B1 | 5/2001 | Tokimoto et al. | |
| 6,253,494 | B1 | 7/2001 | Shaffron | |
| 6,407,798 | B2 | 6/2002 | Graves et al. | |
| 6,409,599 | B1 | 6/2002 | Sprout et al. | |
| 6,578,971 | B1 | 6/2003 | Neff | |
| 6,593,957 | B1 | 7/2003 | Christie | |
| 6,727,971 | B2 | 4/2004 | Lucas | |
| 6,733,136 | B2 | 5/2004 | Lantz et al. | |
| 6,848,219 | B2 | 2/2005 | Standard et al. | |
| 6,909,543 | B2 | 6/2005 | Lantz | |
| 6,937,295 | B2 | 8/2005 | Islam et al. | |
| 7,125,074 | B2 | 10/2006 | Real et al. | |
| 7,159,938 | B1 | 1/2007 | Shiraishi | |
| 7,545,108 | B2 | 6/2009 | Flessas | |
| 7,791,799 | B1 | 9/2010 | Lejeune et al. | |
| 8,012,023 | B2 | 9/2011 | Gates et al. | |
| 8,054,547 | B2 | 11/2011 | Anderson et al. | |
| 8,194,315 | B2 | 6/2012 | Sharp et al. | |
| 8,206,230 | B2 | 6/2012 | Magpuri | |
| 8,668,045 | B2 * | 3/2014 | Cohen | A61H 23/0236 181/150 |
| 9,729,961 | B2 | 8/2017 | Howard et al. | |
| 2004/0183656 | A1 | 9/2004 | Abel et al. | |
| 2005/0224281 | A1 * | 10/2005 | Gordon | G10K 11/004 181/153 |
| 2008/0186415 | A1 | 8/2008 | Boud et al. | |
| 2008/0211972 | A1 | 9/2008 | Congard et al. | |
| 2008/0297487 | A1 | 12/2008 | Hotelling et al. | |
| 2008/0309623 | A1 | 12/2008 | Hotelling et al. | |
| 2009/0067657 | A1 | 3/2009 | Yasushi et al. | |
| 2009/0120429 | A1 | 5/2009 | Fowler | |
| 2009/0154737 | A1 * | 6/2009 | Ostler | A47C 7/72 381/301 |
| 2010/0073468 | A1 | 3/2010 | Kutner | |
| 2010/0123880 | A1 | 5/2010 | Oren | |
| 2010/0205867 | A1 * | 8/2010 | Park | A47C 1/12 52/8 |
| 2011/0058113 | A1 | 3/2011 | Threlkel et al. | |
| 2011/0116048 | A1 | 5/2011 | Read et al. | |
| 2011/0170074 | A1 | 7/2011 | Ferren et al. | |
| 2012/0224311 | A1 | 9/2012 | Sutherland et al. | |
| 2012/0247030 | A1 | 10/2012 | Magpuri | |
| 2012/0250912 | A1 | 10/2012 | Chung | |
| 2012/0280924 | A1 | 11/2012 | Kummer et al. | |

OTHER PUBLICATIONS

International Search Report and Written Opinion for PCT/US2014/016947, dated Aug. 5, 2014.

Non-Final Office Action on U.S. Appl. No. 14/183,208, dated Oct. 2, 2014.

* cited by examiner

IMMERSIVE SOUND SYSTEM

CROSS-REFERENCE TO RELATED APPLICATIONS

This application is a divisional of U.S. application Ser. No. 14/183,208, filed Feb. 18, 2014, which claims the benefit of priority to U.S. Provisional Application No. 61/766,571, filed Feb. 19, 2013, the entire contents of which are incorporated by reference herein and for all purposes.

BACKGROUND OF THE DISCLOSURE

In a conventional theater environment, speakers presenting audio content to an audience may be placed around the unused walls, rear, and other portions of the theater room. However, in a theater that provides an immersive display experience (i.e. a screen or set of screens that surrounds the audience), such unused areas situated around the user are not easily available. The present inventors have recognized that various problems impede the creation of a practical audio system designed for a fully immersive display environment. For example, providing a sound system behind or even near traditional theater display screens, which are lightweight and highly reflective, may produce undesirable image effects due to the movement of the screen. As another example, if speakers are placed too close to light sources involved in the video display, then the movement of these light sources may also produce troublesome visual effects.

The present inventors also recognized that sound production in an immersive theater environment might be difficult to isolate from external noise and from internal echoes. Such issues may be especially difficult in theaters wherein the enclosure/screen is curved. In particular, sounds introduced into an immersive theater room, the sound may continue to echo throughout the theater room because of the geometry and/or materials, producing muddled audio.

SUMMARY OF THE DISCLOSURE

Described herein are sound systems for an entertainment venue that provide for enhanced audio in an immersive environment. In one embodiment, an example speaker system includes a transparent material that covers an immersive display screen. The transparent material is wired to produce both sound-detecting and sound producing sections. The sections include microphone sections spread across the display screen and noise-cancellation speakers adjacent to the microphones, providing an active noise cancellation system. The sections may also include theater-speaker sections for presenting audio to a theater area.

In another embodiment, an in-seat speaker system includes several speakers in a theater chair, placed in various locations. In particular, the chair may contain a pair of speakers above the ears and a pair below the ears (or just one speaker for each ear), set within the headrest area of the chair.

In other embodiments, a speaker arrangement for an immersive theater area includes a speaker area in one section of the periphery of the theater area (upper center of the torus in a toroidal embodiment), and an additional speaker arrangement such as:

i. In the case of a "font projection only" system, a screen made of a sound deadening material (such as foam) that includes thinner sections behind which speakers reside.
ii. In the case of a "font projection only" system, a screen made of a material essentially transparent to sound (e.g., perforated aluminum), with both sound deadening material (e.g., fiberglass) and speakers residing behind it.
iii. In the case of a "one LED screen only" system: a screen made of "transparent" LED panels which are essentially transparent to sound, and behind which reside both speakers and sound deadening material.
iv. In the case of any visual exhibition system, in order to supplement the in-seat system (so audio is audile when the audience member is not seated, or if certain audience members do not have an in-seat system) speakers may be mounted upstage and facing up and away from the audience that propagate sound into and along the surface of the torus shape. The torus would ultimately direct the sound around itself and into the audience, effectively turning the entire torus itself into a speaker cabinet.
v. In the case of a "compositing screen" (in which an image on a semi-transparent "front screen" is viewed simultaneously with an image on a back screen through the front screen), a "front screen" which is mostly transparent to sound (i.e., perforated aluminum), with a back screen made of transparent LED panels which are essentially transparent to sound, and behind which reside both speakers and sound deadening material.

In yet another embodiment, a method of immersive sound control may involve using sections of a material layer to detect sounds, and using adjacent sections of the material layer to produce out of phase acoustic vibrations that cancel out the detected sounds (so as to eliminate the reflected sound). The method may also involve using other sections of the material layer as theater speakers to present audio to the theater area.

The foregoing is a summary and thus by necessity contains simplifications, generalizations and omissions of detail. Consequently, those skilled in the art will appreciate that the summary is illustrative only and is not intended to be limiting. Other aspects, inventive features, and advantages of the various elements, devices, and/or processes described herein will become apparent in the detailed description set forth herein and taken in conjunction with the accompanying drawings. Additionally, features discussed in the summary of the disclosure are example embodiments and need not be included in all embodiments.

DETAILED DESCRIPTION

Referring to the figures, various embodiments of a sound system that may be used in an immersive theater environment are described along with accompanying systems and the immersive theater venue. Although the sound systems may be used in the example venue, other venues, theater areas, and sound system geometries may be alternatively used. In one such embodiment, the sound system controls the sound in a toroidal environment.

The following description is divided into two sections: Venue Architecture and Systems and Audio System Design. The venue architecture and systems section describes the environment in which the sound system may be used, including some of the systems, techniques, structures, and devices that are used to facilitate the functions of an entertainment venue that uses the sound system. The audio system design section describes the physical design and layout of an example system and the methods of use. Additional information and disclosure regarding the venue, stage, and display technology that may be used in combination with the embodiments disclosed herein may be found in copending U.S. application Ser. No. 14/183,231 (entitled "Entertainment Venue And Associated Systems/Methods"), U.S. application Ser. No. 14/183,077 (entitled "Rotating Performance Stage"), and U.S. application Ser. No. 14/187,3162 (entitled "Compositing Screen"), which are incorporated herein by reference.

Venue Architecture and Systems

Figure 1:
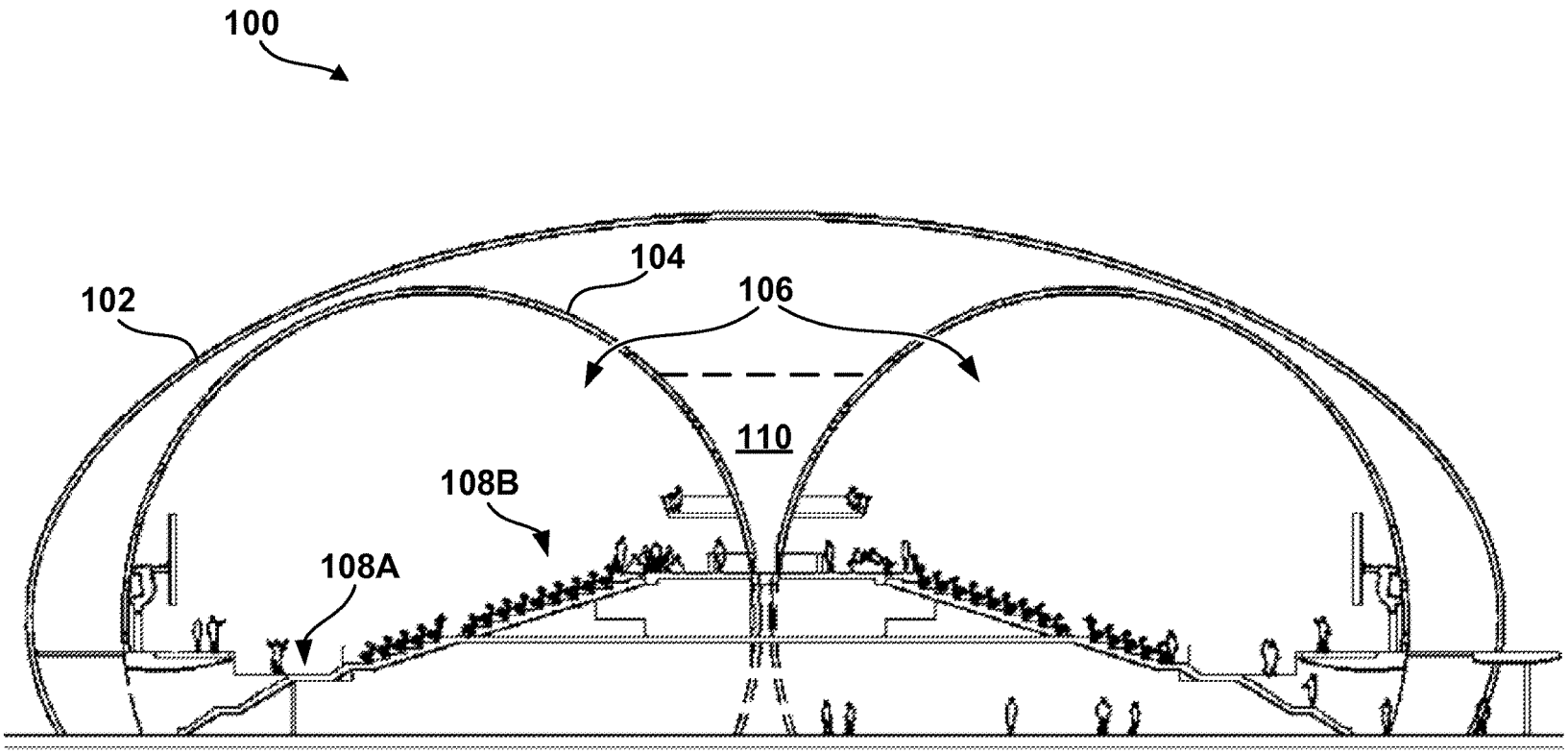
FIG. 1 is a layout design of an exemplary venue with a one-screen 360° theater IDS embodiment.

FIG. 1 shows one embodiment of an entertainment venue 100. As shown, venue 100 includes a dome-shaped exterior 102 over a torus-shaped interior structure 104 that encloses a theater area 106. Theater area 106 includes various levels of audience standing 108A and seating 108B. In addition to theater area 106, FIG. 1 shows other areas of venue 100, including, torus-center area 110. Torus-center area 110, and/or the other open portions below enclosure 102, may house various mechanical, audio/visual, utility, and other elements that support the functions of venue 100. For example, projectors, speakers, cabling, switching systems, plumbing, HVAC, safety equipment, ladders, catwalks, cameras, house lighting, Emergency Exit signs, rigging, and/or control stations, among other possibilities, may also be held in torus-center area 110. Since the interior structure 104 and enclosed theater area 106 are toroidal in shape, FIG. 1 shows theater area 106 (along with corresponding portions of standing 108A and seating 108B areas) in two segments. In an example embodiment, the arrangement of interior structure 104, theater area 106, standing 108A, and seating 108B may continue around the circumference of the toroidal shape. As will be described in the following sections, various alternative embodiments may include fewer, additional, or different elements than the arrangement shown in FIG. 1.

I. External Enclosure

One embodiment of an external enclosure is a "dome" shaped shell enclosing the indoor toroidal enclosure and various theater features of the entertainment venue. FIG. 1 shows such an implementation, in which the exterior shell is in the shape of an ellipsoid. Other example embodiments could include spherical, hemispherical, rectangular, cubic, pyramid shaped, toroidal, conical, or other shape of exterior enclosures. In some cases, the implementation of the shell exterior may be supported separately from the display screen to handle various loads, such as wind loads that will not be a requirement for the internal enclosure. In other implementations, the display screen and exterior may be supported by connected rigging to the interior structure, as a function of load support or stationary support. Structural supports for the exterior ellipsoid or internal torus, the display screen, rear screens (if applicable), speakers, lighting, A/C, heat, ducting, rigging and more may include various internal framing components, framing support and/or external superstructural components.

Although FIG. 1 shows enclosure 102 housing a single theater area 106, an example entertainment venue may include multiple theater areas (e.g., multiple viewing areas with similar or different content, within the single theater). Each respective theater area, if separated, may include its own display screens, performance stages, and/or other features to facilitate all entertainment activities.

II. Audience Area

An audience area may be provided inside any of the theater areas. As shown in FIG. 1, the audience area may include a standing room area (SRO) 108A and various seating areas 108B for audience members of both General Audience (GA) or (VIP) areas. The audience area may also include open spaces or non-obstructed spaces to be used interchangeably in accordance with particular entertainment events. For example, open areas may be used as dance floors, orchestra pits, security zones, theatrical displays, non-permanent seating additional stage areas (such as trusses, jets), additional lighting or sound rigs, pyrotechnic or lighting displays, smoke, smog, live actors or stage performers, among other examples. In some embodiments, the entire audience area may rotate either in lieu of, or in combination with, the actual stage rotating. In another embodiment, select audience areas may contain motion seats.

In an exemplary embodiment, the audience seating 108B may face outward from a central area of the theater. In some embodiments, each seat may be oriented in a direction facing away from a central point. In other embodiments, rows of seats may face substantially outward although each individual seat may not face directly outward. In other embodiments, rows of seats may face inward. In still other embodiments, seat direction may be changeable, movable or interchangeable, or entire sections may be changeable, movable, or interchangeable. For example, seats may be able to rotate, or have some degree of motion (a third sensory element—movement).

Seats with changeable orientation may freely rotate, allowing the audience to turn their own seats during an event, or the orientation of the seats may be changeable by technology or programming to facilitate different events. For instance, to prepare for a show in which the action takes place on a central active area of the stage, seats may face or move to the active area of the stage, or mirror the actions of the content, live performance or other rather than move in one specific direction. In some implementations, the entire platform, or partial sections of the platform, upon which the seats rest could move.

III. Performance Stage

One or more performance stages may be provided in each of the venue's theater areas, as opposed to one continuous stage. As shown in FIG. 1, a performance stage may include a rotating ring-shaped stage encircling the audience area 110. This stage may be split into multiple rotating stages, as in half the venue or quarters of the venue. The stage 110 may also be split in itself, where one-half of the stage (as in front and back) may rotate, where the other half may remain stationary, creating different visual effects. As another example, theaters which are not circularly symmetric may include stages that fit to the particular geometry of the room such as cubic or square shaped. In a theater area with more than one performance stage, the multiple stages may include various types of stages in addition to, or instead of, multiple instances of one type of stage.

In some embodiments, a movable performance stage may be used. For example, ring-shaped performance stage 110 may be designed to controllably rotate around the outside of theater area 106 or stand still. This movement may be uniform in speed or changeable. For example, stage 110 may either continuously move throughout the performance or stop periodically so that portions of stage 110 are directly in front of particular audience sections. The motion of the stage can be synchronized with the projected visuals so as to cause the audience to feel that it is they who are moving. The stage can also speed up or slow down, depending on need. In other embodiments, a performance stage may be designed to move vertically or into/away from the audience area, such as the front two thirds of the stage extending into the audience where the back third remains motionless.

IV. Display Screens

FIG. 1 shows an exemplary venue that includes a theater screen (toroidal screen 106). Different embodiments may include other types, layers, and numbers of screens. For example, some embodiments may include only a theater screen but no secondary screens. As another example, multiple theater screens may also be used throughout the single theater area, and come together as one image via a "raid".

FIG. 1 shows a toroidal screen 106 as an example of a theater screen. Since toroidal screen 106 wraps around the audience in a way that immerses the viewers in a display space, this type of screen may be considered an Immersive Display Screen (IDS). In other implementations, the IDS could be various other shapes, including spherical, hemispherical, rectangular, cubic, pyramid shaped, conical, prismatic, and cylindrical, among others. Additionally or alternatively, some embodiments may use non-immersive theater display screens. Although toroidal screen 106 is shown as a single continuous screen with no gaps, example screens may include multiple screen pieces arranged to function as a single display screen. In some arrangements, the IDS may include non-screen areas within the screen surface, while still being considered a single screen, meaning some of the IDS may display content where other areas of the screen may not. For example, toroidal screen 106 may have supporting structures rather than active display areas behind it, as a secondary screen, and still be considered substantially continuous.

Display screen 106 may present or display images and video in a number of different ways and explorations. For example, one or more projection devices may project images onto, or from, screen 106. Such projectors may be placed inside the theater area 104 to project images onto the inside of screen 106 (i.e. front projection). In other embodiments, projectors may be placed around the outside of the theater area to illuminate visible internal portions of the screen by projecting images onto the backside of the screen (i.e., rear projection). In other embodiments, projectors may be placed behind the display screen 106, shining through but remaining hidden to the audience. In some cases, multiple projectors may project onto different areas of the screen. In other cases, the projection areas may overlap or projectors may be stacked on one another. In still other cases, multiple projectors may illuminate substantially the same areas of the screen to increase brightness, luminosity and image resolution.

In addition to light-projection systems, various other visual display devices may produce images on theater screen 106. For example, multiple light sources may be embedded into, in front of, and/or behind the screen to forma a multiple image display. Any of various light source types may be used in such an arrangement. For instance, light emitting diodes (LEDs), other electroluminescent components, incandescent light sources, gas discharge sources, lasers, electron emission sources, and/or quantum dot sources may be used to realize the display, among other examples. In particular, low pixel pitch LED arrays may be embedded over the screen surface of a theater screen, so that no projection systems would be necessary. In another implementation, screen 106 may be optically responsive to electron bombardment (e.g., a fluorescent screen). Then, a cathode-ray source may activate portions of the screen to produce images.

Figure 6:
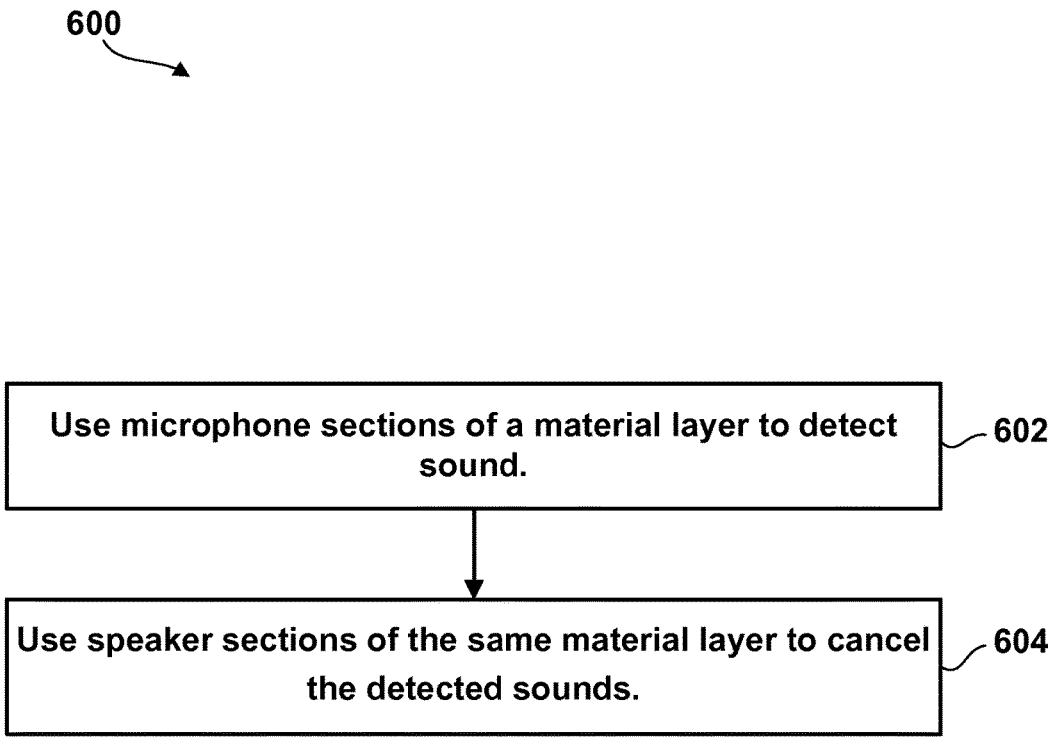
FIG. 6 illustrates steps of an example process.

In some implementations, a display screen may be configured to provide multiple images at once. FIG. 6 shows an expanded view of an example such screen that includes and LED back screen 602 behind a projection-based front screen 606. For example, the front screen may be a material or structure that is semipermeable to light emanating from behind it, but also sufficiently reflective of light projected onto its front by a laser projector, allowing such a projector to superimpose an image over the LED back screen. In this way, a 3D three-dimensional image or a "composite" and/or parallax image may be produced by the physical separation between both projected images. Examples of semipermeable screen structures are a perforated aluminum screen (with a sufficiently high void percentage, and sufficiently high reflective coating) vinyl, Teflon, plastic or other, and/or clear ETFE backed with partially transparent front projection film, and with a clear layer of sound absorbent film affixed to its front.

Other examples of display systems for both the front and rear screens may include: Front or rear projection, LEDs, laser projection, ASD LEDs, ASD front projection, holography, 3D "ghosting" or full 3D effect (e.g. Pepper's Ghost or a Steinmeyer illusion).

To facilitate using the entertainment venue, a variety of supporting systems may also be included. Some supporting systems are described herein with regard to features that are not used in a typical movie or live-theater setting while others are not specifically mentioned by name or described herein. Other systems and structures may also support the entertainment venue; but those may be obvious to persons of skill in the art. In some embodiments, processing of both audio and video feeds and/or equipment may be run under the stage or audience. In other embodiments, support equipment may run on the outside of screen 106 or in the cows nest shown in FIG. 1.

Audio System Design

Any of various audio systems may be provided for a theater area. Audio input devices may be provided to support sounds associated with live performances and/or pre-recorded elements on screen. For example, musical acts may use input devices to capture voice and instrument sounds from a live musical performance. As another example, stage acts may use microphones to capture on-stage voices and sound effects. As another example, the theater screens may project sounds, voices, music, etc. as if a live concert were taking place. As yet another example, sound-detection systems may support noise and/or noise-cancellation systems. Audio output devices may output captured or generated sounds and other audio associated with live performances or video displays.

As will be described, audio output devices, such as speakers, may be provided in any of various locations inside or outside of the theater area, and speakers may be existing or new technologies, or a mix of both for this specific venue. For example, speakers may be provided on or around the stage area, around secondary display screens, and/or under and around the audience area. And, in some cases, individual speaker systems may be provided within the audience seating area (e.g., chair-mounted speakers). In some embodiments, speakers may be provided behind, within, or transparently in front of the theater screen.

The implementation and orientation of the speakers and audio system will vary based on various factors. For example, the implementation may change based on whether an in-front and/or a behind-the-screen speaker implementation is used. Such variations may follow in accordance with particular audio requirements and in such a fashion as to deaden reflected and reverberated secondary sound waves, which may otherwise result from the theater or screen design and screen elements (i.e., LEDs if applicable).

In order to provide a stable, coherent image on the theater screens, and optimal audio quality, several solutions for sound dampening elements may cover up and/or protect parts of the screen that are more susceptible to audio acoustic vibrations, reflections or reverberation. For example, a screen material that is practically transparent to sound (like perforated aluminum) may have both speakers and sound deadening material placed behind it, thereby preventing the sound systems from impairing the audience's view of the screen).

In a dual-screen implementation with a front projection screen surface (such as a perforated surface) and a back LED screen surface, speakers and sound deadening material may be placed behind the back LED surface (which may be essentially transparent to audio). In another implementation, LEDs may cover the speakers behind speaker grills, while an absorptive material (such as vinyl) may be placed over the LEDs (with holes cut from which each LED may protrude to create a seamless visual experience while providing the venue with sound deadening properties.

In a one LED screen implementation, speakers and sound deadening material may be placed behind the LED surface (which is essentially transparent to audio). In another implementation, LEDs may cover the speakers behind speaker grills, while an absorptive material (such as vinyl) may be placed over the LEDs (with holes cut for each LED to protrude from) to create a seamless visual experience while providing the venue with sound deadening properties.

In another audio solution, an active noise cancellation system may be employed. In this example, a transparent Mylar, plastic, or other material would cover all or part of the inside facing surface of the front screen, and would be wired to act as speakers and microphones. In such an implementation, small sections, interspersed across the screen area, may be wired to act as microphones. Additionally, other adjacent sections may be interspersed adjacent to the microphone areas and may be wired to act as speakers. The speakers may cancel sound detected by the microphones by, for example, producing an out-of-phase acoustic wave of the sound detected by the adjacent microphone section. Further, additional sections of the covering (positioned further away from the sections wired as microphones) may be wired to act as speakers that would transmit audio intended to be heard by the audience (i.e., music, dialogue, sound effects, etc.). In this way, the torus itself (as a structure) acts as both a speaker system and an acoustical deadening solution.

In another embodiment, soundproofing and speakers may be placed behind the LED surface with speaker grills covered in LEDs. Spaces between the LEDs may make the LED panels at least partially transparent to audio, allowing the speakers to present audio to the audience through the front screen and/or back LED screen.

In still another example, the screen may be made "transparent" to sound via perforated gaps in the screen through which sound waves flow without disturbing the screen and without creating reflections. Behind the gaps, sound-absorbing material or active cancellation systems may cover the back of the screen. In this way, the screen shield may deaden the sound while also allowing sound to pass through the gaps in the surface.

Figure 2:
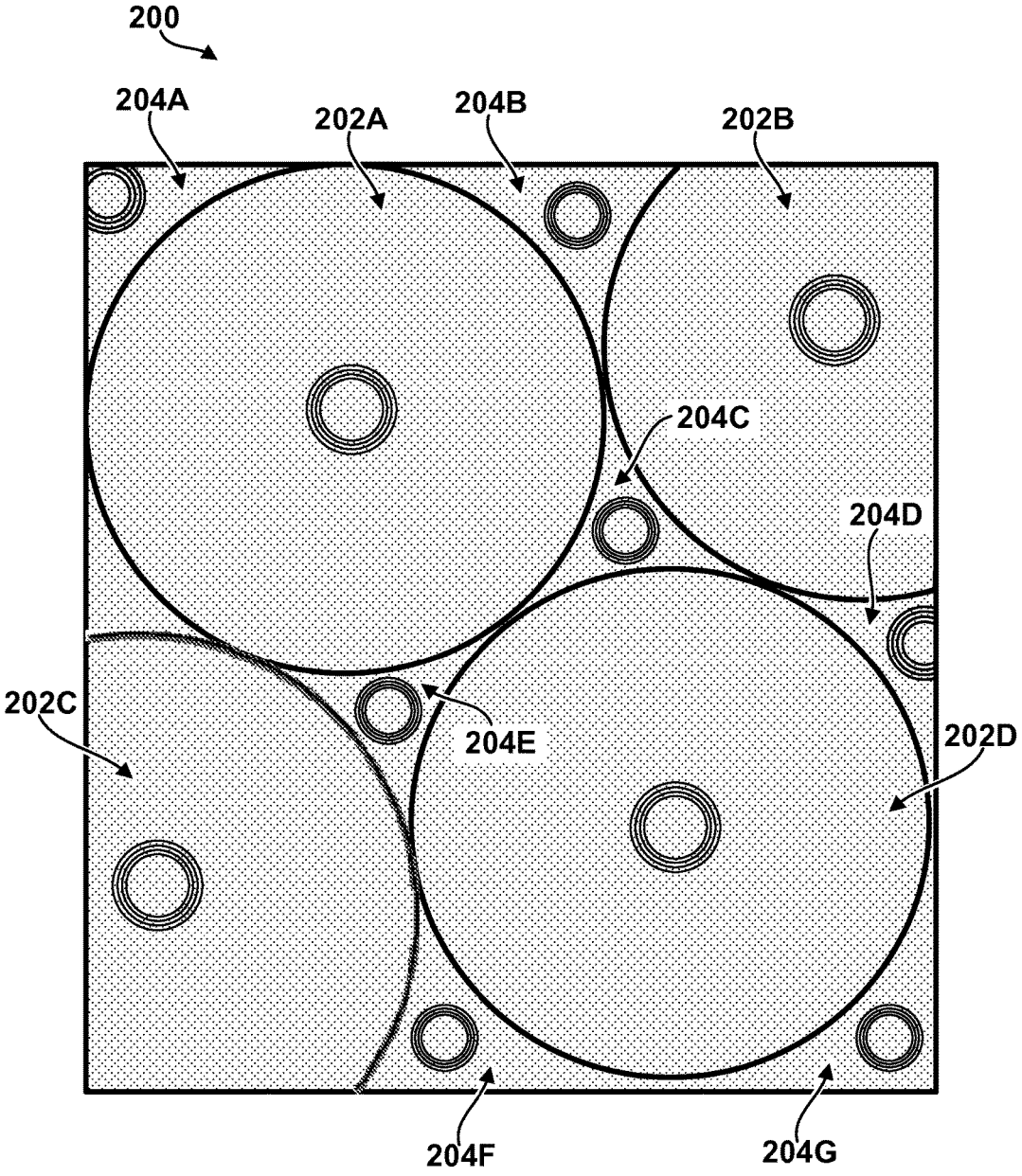
FIG. 2 illustrates an example of a continuous-film audio system.

FIGS. 2-5 show particular implementations of audio control and output systems. FIG. 2 shows an arrangement that includes an example material layer 200 divided into various sections. In particular, large sections 202A-202D may be speaker sections and small sections 204A-204G may be microphone sections. Such a film may substantially cover a theater screen to produce a "Phase-Cancelling Screen" arrangement. As shown, each section includes wiring to facilitate audio input or output. Although the sections are shown as divided out by physical dividers, some embodiments may only behave as if certain areas of the material are dedicated speaker or microphone sections. In an example embodiment, electrical signals from the microphone section may be received into control circuitry and control circuitry may send out signals to the speaker section wirings. For an active noise-cancellation system, the detected sounds and the generated sounds may be inverted versions of one another such that the acoustic waves coming in are canceled by the waves coming back out. In this way, acoustic reflections may be prevented or minimized. at the surface. In some implementations, other sections of the material layer may be designated for audio output other than noise cancellation. For example, the other speakers may play the audio to accompany a live performance or a video presentation. In an example embodiment, the material may be stretched, attached, or bonded across all or most of a theater screen, so that the sound in the theater area may be controlled by the system. Various materials and structures may be used for the material layer. In an example embodiment, the material layer may be transparent so that the layer does not interfere with displays from the screen behind it.

Figure 3:
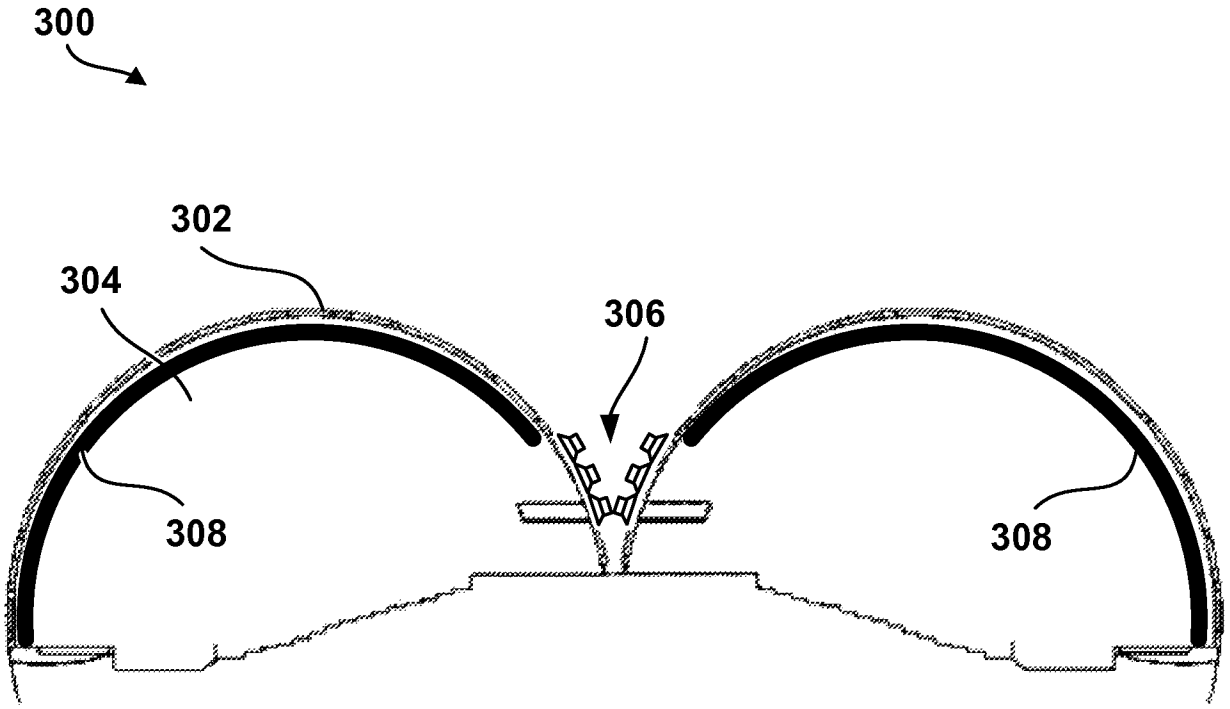
FIG. 3 illustrates an example arrangement of audio devices and soundproofing.

FIG. 3 shows an example speaker and soundproofing arrangement 300. As shown, the arrangement includes a toroidal enclosure 302 enclosing a theater area 304. In the center torus area, a bank of speakers 306 is disposed. Speakers 306 may produce the sound for theater area 306. Additionally as shown, the parts of enclosure 302 that are not part of the speaker area (i.e., the area where the speakers are placed) is covered with soundproofing 308. Speakers may also be dispersed through the entire interior torus area and the soundproofing 308 may be thinned in the areas covering the speakers, rendering each portion transparent to sound. The soundproofing may be a sound-absorbent material layer (e.g., foam, fiberglass, etc.), a sound-absorbent structure (vacuum seal, foam pyramids, etc.) or a noise-cancellation system. In the arrangement, the sound from the speakers may reach the audience, reflecting off at diverse angles and directions, only to be absorbed or cancelled when it reaches soundproofing 308.

Figure 4:
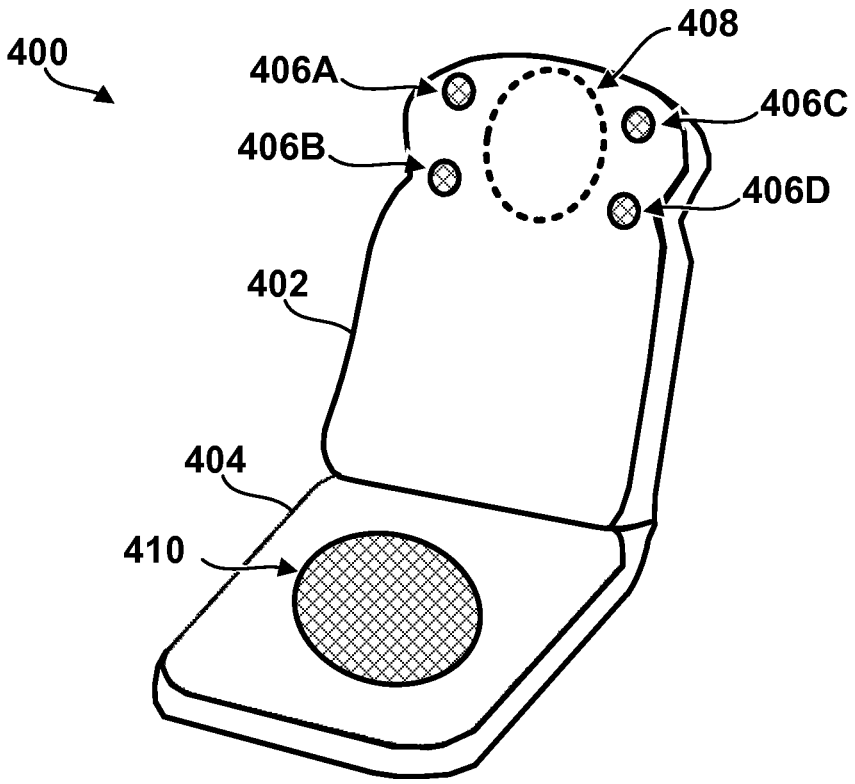
FIG. 4 illustrates an example in-seat speaker arrangement.
Figure 5:
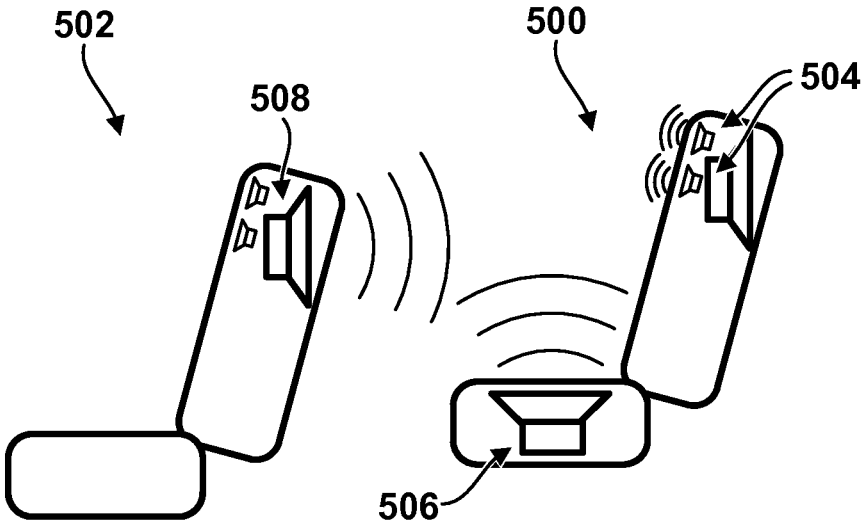
FIG. 5 illustrates an example in-seat speaker arrangement.

FIGS. 4 and 5 show example in-seat speaker configurations. In particular, FIG. 4 shows a theater chair 400 that has a back section 402 and a seat section 404. In the back section, top speakers 406A-406D are arranged around the concave headrest of the seat in a way that surrounds the area that a guest's head would occupy (shown as 408), where distinct audio signals may be transmitted through each driver. Sound coming from speakers on one side of the listener's head is heard almost entirely by the ear of that side (and not the other ear). This effect may be due to proximity to that ear; and/or due to the tubular passages between each speaker and opening in the headrest, which focuses the sound into a relatively narrow beam; and/or due to a concave parabolic cone or hemisphere the speaker faces (e.g., functioning similar to a parabolic microphone in reverse), which itself faces the ear, which focuses the sound into a relatively narrow beam. This isolation of separate audio channels to each ear makes possible the employment of psycho-acoustic effects to simulate sound emanating from various placements within a three dimensional space, and also makes possible the reproduction of binaurally recorded audio (one or both of which may also be employed). Although four to speakers are shown here, other numbers and arrangements of speakers may be used. For example, one left and one right speaker may be used, one on each side of headrest in 408. As another example, six to speakers may be arranged around head area 408, or three speakers per left channel, three speakers per right channel, to provide a more immersive audio environment. Also as shown, chair 400 includes a speaker 410 in its seat section 404. Large speaker 410 may be a more powerful or higher fidelity speaker because of its size. For example, speakers 406A-406D may be full spectrum speakers, while large speaker 410 may be a woofer or subwoofer.

As shown in FIG. 5, the sound arrangement from a single theater chair 500 may be enhanced by other in-seat speakers. As shown, chair 500 includes top speakers 504 and a seat speaker 506, each arranged to provide audio to a seated guest. Additionally in the arrangement of FIG. 5, a front, center channel speaker 508 is provided in front of the guest seating area of chair 500. In particular, speaker 508 is disposed in the back of chair 502 in the row ahead of chair 500, so the sound from the center channel is reaching the person to the rear of the seat. If seat 502 is the front row, additional speakers may be provided in front of seat 502 to provide a full surrounding audio environment. Although not shown, the front, and possibly sides, of the headrest area may protrude to produce a concave headrest surrounding the head area. Other numbers and arrangements of speakers may be used.

FIG. 6 shows steps in an example method 600 for use with the material layer sound control system illustrated in FIG. 2. As shown, method 600 involves using microphone sections of the material layer to detect ambient sounds (block 602). Method 600 also involves using speaker sections of the same material layer to cancel the detected sounds (block 604). In some embodiments, the speakers may be configured to cancel all sounds that are detected by the microphone sections. In other embodiments, canceling the sounds may involve determining whether the detected sounds are threshold large enough to warrant canceling. In this way the system may preserve resources when sounds are small in magnitude. Also as shown, method 600 involves using other sections of the material layer (positioned further away from the microphone sections) to present audio that is intended for the audience, rather than simply canceling ambient sounds (block 606). Some other methods may not include the step of presenting intended audio. Processing may be performed on the detected sounds so that the canceling sounds are timed correctly. For example, the material layer may not create a great amount of acoustic reflections but the display screen behind the layer may produce the majority of acoustic reflections. In some cases, the active noise cancellation may cancel sounds going toward the screen, to prevent reflections by preventing sound from reaching the screen. In other embodiments, the sound may be permitted to reflect off of the screen and may be canceled as the waves propagate away from the screen through the layer. In such an embodiment, the system may put a delay on the sound generation step that is in accordance with the time that it takes for the sound to propagate to the screen and reflect from the screen. The entirety of the interior (torus) may be covered in the above described systems).

CONCLUSION

The construction and arrangement of the elements of the video and audio systems and methods as shown in the exemplary embodiments are illustrative only. Although only a few embodiments of the present disclosure have been described in detail, those skilled in the art who review this disclosure will readily appreciate that many modifications or alterations are possible over the course of each construction (e.g., variations in sizes, dimensions, structures, shapes and proportions of the various elements, values of parameters, mounting arrangements, use of materials, colors, orientations, etc.) especially when components are built to specifications, without materially departing from the novel teachings and advantages of the subject matter recited. For example, elements shown as integrally formed may be constructed of multiple parts or elements, with slight or major modifications but not modifications in overall principals or strategies. The elements and assemblies may be constructed from any of a wide variety of materials that provide sufficient strength or durability. Additionally, in the subject description, the word "exemplary" is used to mean serving as an example, instance or illustration. Any embodiment or design described herein as "exemplary" is not necessarily to be construed as preferred or advantageous over other embodiments or designs. Rather, use of the word exemplary is intended to present concepts in a concrete manner. Accordingly, all such modifications are intended to be included within the scope of the present disclosure. The order or sequence of any process or method steps may be varied or re-sequenced according to alternative embodiments. Any means-plus-function clause is intended to cover the structures described herein as performing the recited function and not only structural equivalents but also equivalent structures. Other substitutions, modifications, changes, and omissions may be made in the overall design, operating conditions, and arrangement of the preferred and other exemplary embodiments without departing from the actual scope (or baseline ideas, thoughts, principals, etc.) of the present disclosure or from the scope of the appended claims.

Although the figures show a specific order of method steps, the order of the steps may differ from what is depicted, especially in the construction process of the various elements within. Also, two or more steps may be performed concurrently or with partial concurrence. Such variation will depend on the software and hardware systems chosen and on designer choice. All such variations are within the scope of the disclosure. Likewise, software implementations could be accomplished with standard programming techniques with rule based logic and other logic to accomplish the various connection steps, processing steps, comparison steps and decision steps.

What is claimed is:

1. A theater chair having an in-seat speaker arrangement, the theater chair comprising:

a back section having a front side, a rear side, and a headrest area;

a seat section;

one or more top front speakers disposed within the headrest area of the back section of the theater chair and facing a forward direction, wherein the one or more top front speakers are positioned such that the one or more top front speakers direct sound emitted therefrom through the front side of the back section to an occupant of the theater chair;

a rear speaker disposed within the back section of the theater chair, the rear speaker facing a rearward direction opposite the forward direction at which the one or more top front speakers are facing such that the rear speaker directs sound emitted therefrom through the rear side of the back section rearward of the theater chair and away from the occupant of the theater chair; and a lower speaker disposed within the seat section of the theater chair.

2. The theater chair of claim 1, wherein the top front speakers comprise four speakers arranged to provide immersive audio to the headrest area.

3. The theater chair of claim 1, wherein the rear speaker is oriented such that it is operable to present sound to an occupant of a second theater chair positioned behind the theater chair.

4. The theater chair of claim 1, wherein each of the one or more top front speakers presents sound to a single ear-area, wherein the single ear-area is areas in front of the headrest in which a viewer is likely to place their ears.

5. The theater chair of claim 4, wherein the one or more top front speakers comprise parabolic reflecting structures configured to focus the sound to the single ear-area.

6. A seat comprising:

a chair having:

a back section with a headrest; and a seat section; and an in-seat speaker arrangement including:

a first top speaker positioned proximate a first lateral side of the headrest;

a second top speaker positioned proximate an opposing second lateral side of the headrest;

a first concave element of the headrest positioned to receive first sound waves emitted by the first top speaker and structured to focus the first sound waves into a first narrow sound beam toward a first ear of an occupant of the seat; and a second concave element of the headrest positioned to receive second sound waves emitted by the second top speaker and structured to focus the second sound waves into a second narrow sound beam toward a second ear of the occupant of the seat.

7. The seat of claim 6, further comprising one or more lower speakers disposed within the seat section of the chair, wherein the one or more lower speakers comprise woofer or subwoofer speakers.

8. The seat of claim 6, wherein the first top speaker and the second top speaker comprise full spectrum speakers.

9. The seat of claim 6, wherein the first top speaker and the second top speaker are coupled to separate audio channels.

10. Seating for a venue, the seating comprising:

a first chair including:

a first back section;

a first seat section;

a first speaker disposed within the first back section of the first chair, the first speaker facing a forward direction such that the first speaker directs sound emitted therefrom through a front side of the first back section to a first occupant of the first chair; and a second speaker disposed within the first seat section of the first chair, the second speaker positioned such that sound or vibrations emitted therefrom propagate in an upward direction to the first occupant of the first chair; and a second chair positioned in front of the first chair, the second chair including:

a second back section;

a second seat section; and a third speaker disposed within the second back section of the second chair, the third speaker facing a rearward direction opposite the forward direction at which the first speaker is facing such that the third speaker directs sound emitted therefrom in the rearward direction away from a second occupant sitting in the second chair and (ii) through a rear side of the second back section to the first occupant of the first chair;

wherein (i) the first speaker and the second speaker of the first chair and (ii) the third speaker of the second chair cooperatively provide sound waves to the first occupant of the first chair from underneath, forward of, and behind the first occupant.

11. The seat of claim 6, further comprising a rear speaker disposed within the back section of the theater chair, the rear speaker facing a rearward direction opposite a direction at which the one or more top front speakers are facing such that the rear speaker directs sound emitted therefrom through a rear side of the back section rearward of the seat.

* * * * *